US005456887A

United States Patent [19]

Calvo et al.

[11] Patent Number: 5,456,887

[45] Date of Patent: Oct. 10, 1995

[54] TUBE ADAPTER

[75] Inventors: Manuel Calvo, Miami; Nicholas Parker; James N. Hoskinson, both of Sunrise; Etzer Ketant, North Miami; Kyriakos Christou, Miami Lakes; Peter K. Lee; Santos E. Vargas, both of Miami, all of Fla.

[73] Assignee: Coulter Corporation, Miami, Fla.

[21] Appl. No.: 250,201

[22] Filed: May 27, 1994

[51] Int. Cl.[6] ..... B01L 9/00

[52] U.S. Cl. ..... 422/104; 422/102; 435/809; 220/737; 206/305

[58] Field of Search ..... 422/65, 100, 102, 422/104; 435/296, 809, 737; 206/305

[56] References Cited

U.S. PATENT DOCUMENTS 3,679,129 7/1972 Livshitz ..... 422/104
4,944,924 7/1990 Mawhirt et al. ..... 422/104
5,137,693 8/1992 Mawhirt ..... 422/104
5,186,339 2/1993 Heissler ..... 211/74

*Primary Examiner*—David A. Redding
*Attorney, Agent, or Firm*—John T. Winburn; Warren W. Kurz

[57] ABSTRACT

The invention provides a tube adapter for use on a plurality of different types of tubes. The tube adapter includes a sleeve in which to receive smaller diameter tubes. The sleeve preferably includes a bar code reader slot to allow reading of bar codes on the tubes through the sleeve. The sleeve includes a spring portion biased to retain tubes in the tube adapter. The sleeve also preferably includes a key for aligning the tube adapter in a tube cassette. The tube adapter can include a clip to prevent the tube adapter from inadvertently being removed, rotated or dropped from the tube cassette.

10 Claims, 5 Drawing Sheets

TUBE ADAPTER

BACKGROUND OF THE INVENTION

This invention relates generally to piercing specimen collection containers in an automated hematology analyzer. More particularly, the invention is directed to a tube adapter which allows a hematology analyzer to accept, verify and aspirate a plurality of different sizes and types of collection containers.

Automated blood and blood cell analyzers are well known. These analyzers typically utilize a portion of a whole or pre-prepared blood sample. When the blood sample is taken from a subject, it usually is placed into a collection container such as a vial or test tube. With the potential of exposure to highly infectious diseases by an operator, such as the HIV virus or hepatitis, the tube is closed, typically by a rubber stopper. Many types of blood sample sampling devices have been developed, generally following the procedure of piercing the tube stopper to aspirate a portion of the blood sample. The needle probe or cannula then is removed from the tube and the stopper maintains the remainder of the blood sample sealed in the tube.

In automated hematology analyzers, such as a STKS hematology analyzer sold by the assignee of the present invention, Coulter Corporation of Miami, Fla., a plurality of the sample collection containers or tubes are placed into a tube carrier or cassette. The tube cassette then is loaded into the hematology analyzer and moved to an aspiration location. Each collection container or tube individually is moved to the aspiration location and pierced through its stopper by a transfer needle and a portion of the sample removed for analysis in the hematology analyzer.

Currently, there are several major types of collection containers, each of which has a different size and shape. Alignment of each tube in the aspiration location is verified by a tube sensor or detector. Once the tube is verified to be at the aspiration location, the hematology analyzer includes a stripper plate which functions to align and seat the tube and stopper for piercing by the transfer needle. One universal stripper plate which preferably can be utilized in accordance with the present invention is disclosed in U.S. Ser. No. 08/250,624, entitled "Universal Stripper Plate", filed concurrently herewith and incorporated herein by reference.

Conventional tube sensors or detectors are adjusted to sense one size (diameter) of tube and generally have a narrow sensing range of tube diameters. For example, if the tube sensor or detector is adjusted and aligned for large diameter tubes, small diameter tubes can be missed altogether or misaligned in the aspiration location. Therefore, when it is desired to utilize another type of tube, the tube sensor or detector has to be adjusted and aligned to accommodate the other type of tube. This adjustment requires a service operation, since it is a critical adjustment to ensure that the tube sensor or detector is aligned and is operating correctly.

One way of avoiding changing or adjusting of the tube detector is to adapt the tubes to be of the same general size or size range. A self-adjusting tube detector, which preferably can be utilized with the present invention is disclosed in U.S. Ser. No. 08/250,624, entitled "Self Adjusting Tube Detector", filed concurrently herewith and incorporated herein by reference. It is preferable to utilize the self-adjusting tube detector, because there still can be too much variation in diameter between different types of tubes. A physical sensor adjustment still would be required without the self-adjusting tube detector.

It therefore would be desirable to provide a tube adapter which allows the various types and sizes of tubes to be utilized without adjustment of the tube detector, without utilizing individually specialized tube cassettes and without utilizing as complex or as many different stripper plates, which allows full flexibility in handling the different tubes in the hematology analyzer.

SUMMARY OF THE INVENTION

The invention provides a tube adapter for use on a plurality of different types of tubes. The tube adapter includes a sleeve in which to receive smaller diameter tubes. The sleeve preferably includes a bar code reader slot to allow reading of bar codes on the tubes without reading through the sleeve material. The sleeve also preferably includes a key for aligning the tube adapter in a tube cassette. The tube adapter can include a first spring clip to prevent the tubes from inadvertently being removed or dropped from the tube adapter and a second spring clip to prevent the tube adapter from inadvertently being removed or dropped from the tube cassette.

DESCRIPTION OF THE PREFERRED EMBODIMENTS

Figure 1:
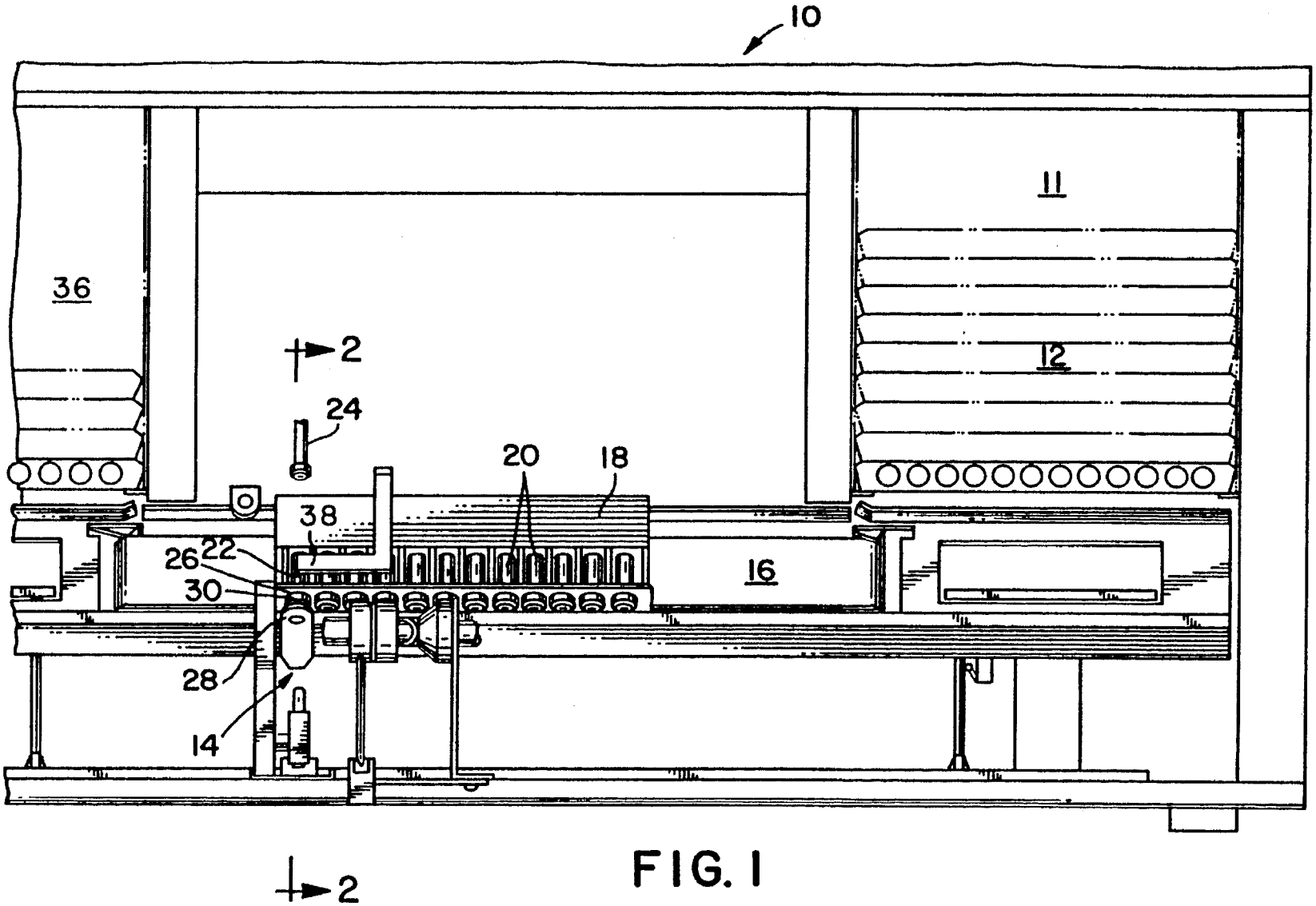
FIG. 1 is a front plan view of one hematology analyzer which can utilize the universal stripper plate of the present invention.
Figure 2:
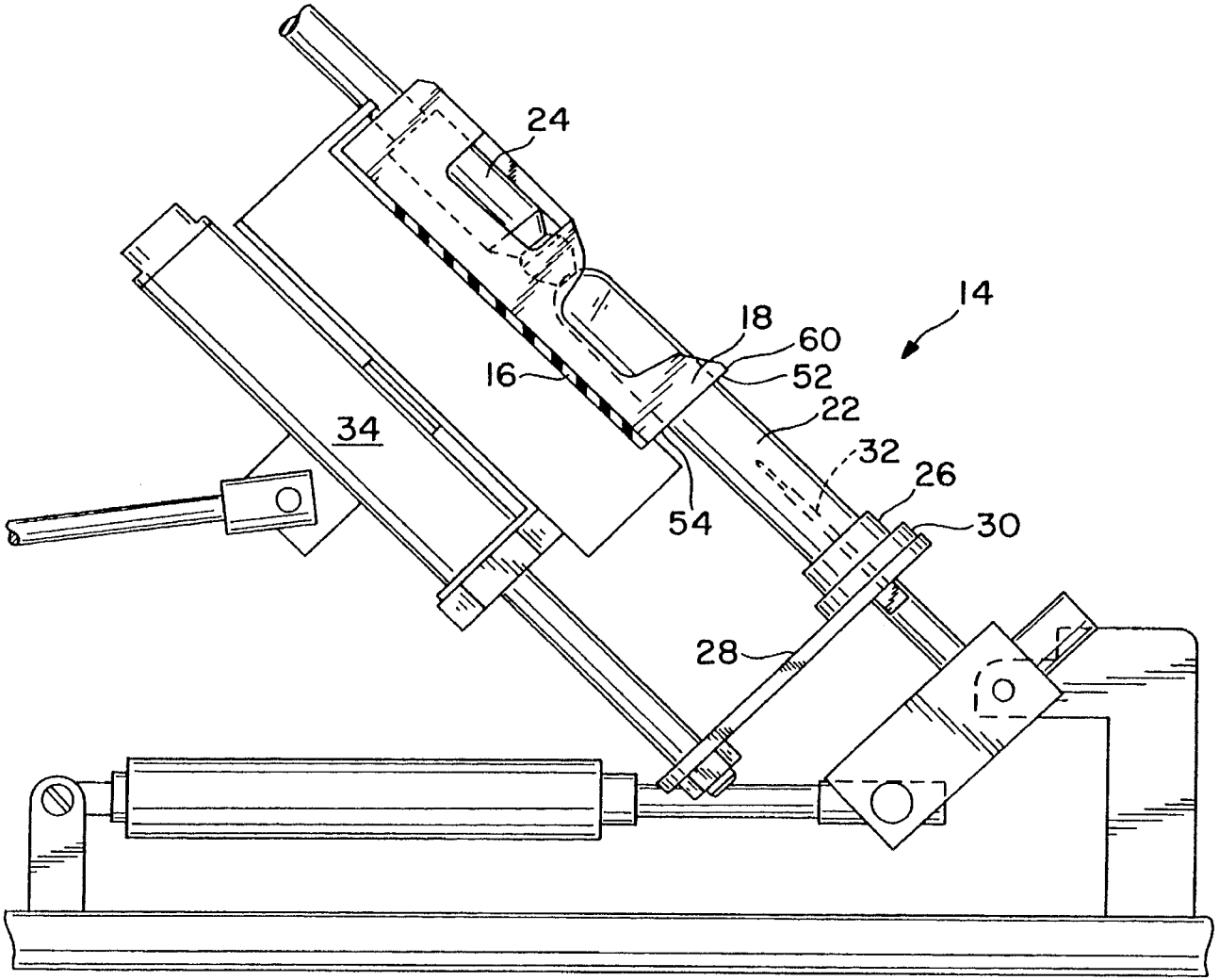
FIG. 2 is a side view of the hematology analyzer taken along the line 2—2 of FIG. 1.

Referring to FIGS. 1 and 2, a hematology analyzer 10 is generally illustrated. Specific details of the operative components are more fully described in U.S. Pat. Nos. 3,549,994 and 4,609,017, which details are not considered essential for a description of the present invention. The hematology analyzer 10 includes a sample collection container or tube input area 11 including a plurality of tube carriers or cassettes 12, which are fed into a piercing and aspiration station 14 by a transport device such as a conveyor belt 16. One tube carrier or cassette 18 is illustrated in the aspiration station 14 containing a plurality of collection containers or tubes 20.

One tube 22 is aligned in an aspiration location and is aligned with a push rod 24, which will push the tube 22 partially out of the cassette 18. The push rod 24 pushes the tube 22 to abut a stopper or cap 26 of the tube 22 against a stripper bar or plate 28. The plate 28 includes a conventional stripper button 30, which aligns the cap 26 with an aspiration probe tip or needle 32 which is driven through the cap 26, typically by the push rod 24. After aspiration, the tube 22 is driven back into the cassette 18 in a conventional manner, typically by a drive cylinder 34. One preferable aspiration operation is disclosed in cross-referenced application, U.S. Ser. No. 08/250,265, entitled "Universal Stripper Plate" which universal stripper plate would replace the conventional stripper bar or plate 28 and the conventional stripper button 30.

Each tube or collection container 20 is in turn moved into the aspiration location and operated on in a similar manner. Once all the tubes 20 in the cassette 18 are aspirated, the cassette 18 is moved to an output area 36.

The correct position and alignment of the tube 22 in the aspiration location aligned with the axis of the aspiration needle 32, must be verified by a sensor, such as a conventional fixed sensor 38. As previously referenced, the sensor 38 is located in a fixed position and typically cannot accommodate various size tubes. A preferable adjustable tube sensor which can be utilized with the present invention is disclosed in cross-referenced application, U.S. Ser. No. 08/250,624, entitled "Self-Adjusting Tube Detector", which self-adjusting tube adapter would replace the conventional fixed sensor 38.

Figure 3:
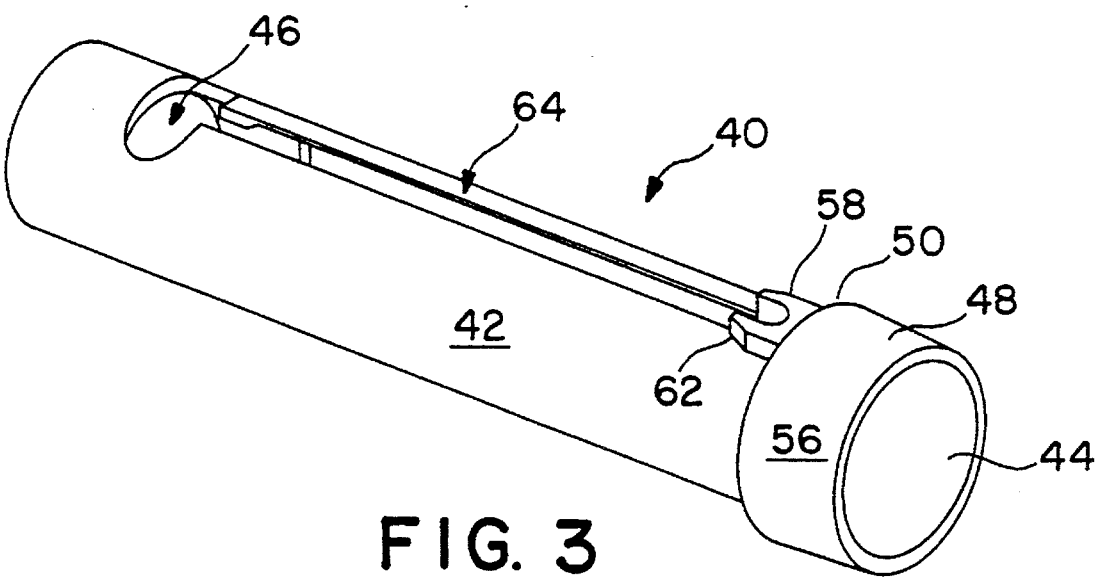
FIG. 3 is a perspective view of one embodiment of the tube adapter of the present invention.

Referring to FIG. 3, a perspective view of a first tube adapter embodiment of the present invention is designated generally by the reference numeral 40. The tube adapter 40 includes a hollow sleeve 42 sized to fit a Sarstedt tube (FIG. 6D) internally thereof through a mouth or opening 44. A tube (not illustrated) preferably is retained by a first spring clip (FIG. 4) within the sleeve 42 and can be released through a base release opening 46.

Previous tube adapters have included the sleeve 42 and the release opening 46, but have not included the following features which are preferable for utilization in the cassettes 12, 18. The sleeve 42 includes a shoulder 48 formed partially or totally therearound, either secured or adhered thereto, or formed or molded as one piece with the sleeve 42. The shoulder 48 includes a rear wall or edge 50. The tube adapter 40 is inserted into the cassette 18 (FIG. 2) until the wall 50 abuts a face 52 of a first wall 54 of the cassette 18. The shoulder 48 preferably includes a tapered annular wall 56. The annular wall 56 performs two functions, providing both a clearance for the stripper plate 28 as well as a guide for a stripper button 92 (FIGS. 6A–6D).

Figure 7:
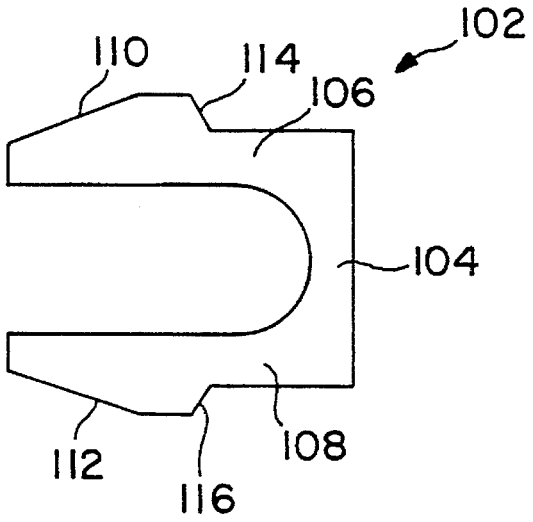
FIG. 7 is an enlarged top plan view of a spring clip retainer for the tube adapter of the present invention.
Figure 4A:
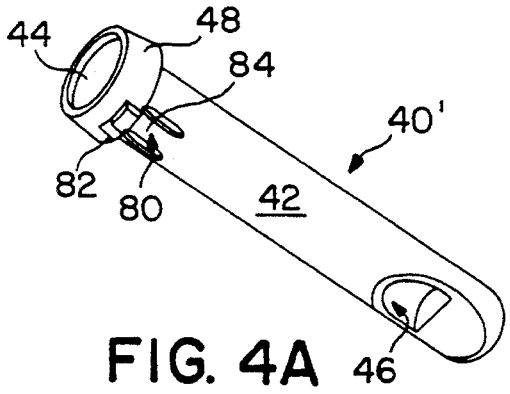
FIGS. 4A–4D are perspective views of a second embodiment of the tube adapter of the present invention.
Figure 5A:
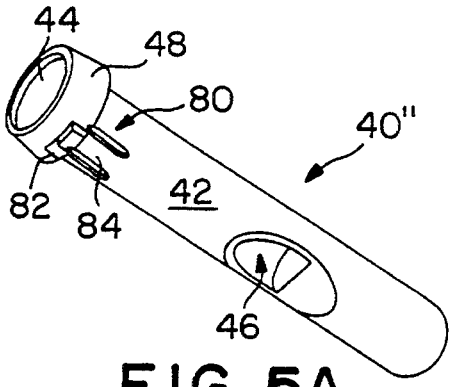
FIGS. 5A–5D are perspective views of a third embodiment of the tube adapter of the present invention.
Figure 4B:
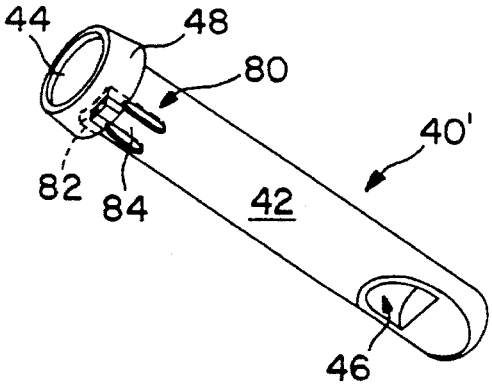
Figure 5B:
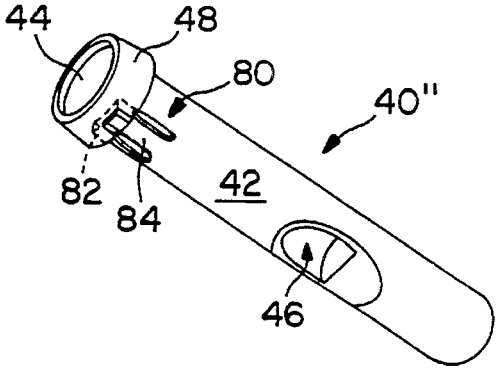
Figure 4C:
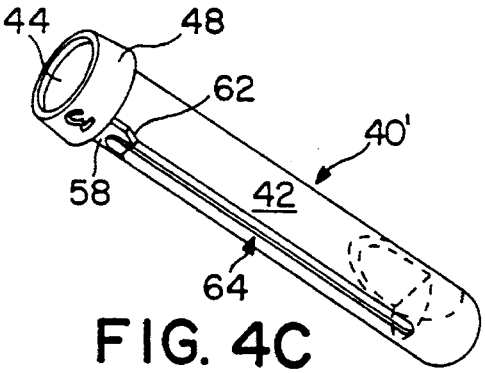
Figure 5C:
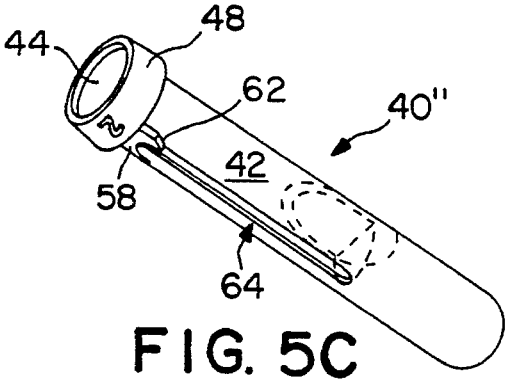
Figure 4D:
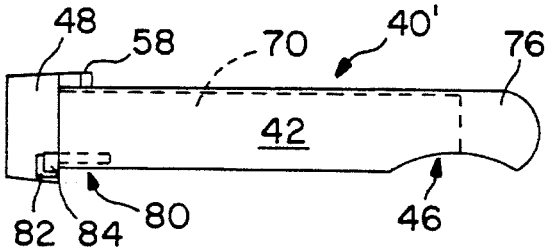
Figure 5D:
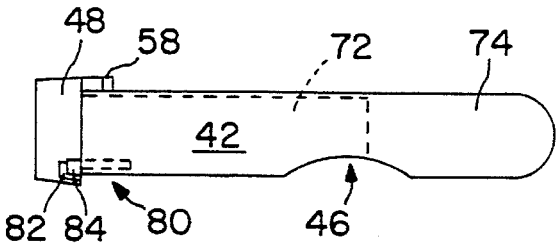

The tube adapter 40 also includes an alignment key 58 formed with or secured to the sleeve 42. The alignment key 58 slides through a slot (not illustrated) in an upper portion 60 of the cassette 18 (FIG. 2). The alignment key 58 preferably includes a tapered front portion 62 for ease of alignment and insertion of the alignment key 58 in the cassette slot. The alignment key 58 also preferably includes a spring clip to retain the tube adapter 40 in the cassette 18, as illustrated in FIG. 7. The alignment key 58 is centered on the sleeve 42 over a bar code reader slot 64 formed along the length of the sleeve 42. The bar code reader slot 64 facilitates the reading of a bar code on a tube (not illustrated) in the tube adapter 40 without interference reflections or refractions caused by the material, such as plastic, from which the tube adapter 40 is formed.

Two further embodiments of the tube adapter of the present invention are designated generally by the respective reference numerals 40' and 40" in FIGS. 4A–D and FIGS. 5A–D. The same reference numerals will be utilized for essentially the same parts on the tube adapters 40, 40' and 40". The tube adapters 40' and 40" differ from the tube adapter 40 only in physical length and internal dimensions, as more clearly illustrated in FIGS. 6B–6D. The tube adapter 40' is designed for a three (3) ml tube, while the tube adapter 40" is designed for a two (2) ml tube and therefore differs only in length (see FIGS. 6B and 6C).

The tube adapter 40' includes a larger internal cavity 70 than the tube adapter 40", which has an internal cavity 72. Since the tube adapters 40' and 40" are formed essentially of the same outer dimensions, the tube adapter 40" includes a larger solid base portion 74 than does the tube adapter 40', which includes a solid base portion 76.

The tube adapters 40' and 40" include a feature preferably included, but not illustrated with the tube adapter 40. It is preferable to retain the tubes in the tube adapters 40, 40', or 40" without the possibility of the tubes falling out of the tube adapter. Most tubes are made of glass and therefore can break or crack if dropped, which also has the effect of loss of the sample contained in the tube.

The tube adapters 40' and 40" include a first spring tube clip or retainer 80. A U-shaped slot 82 preferably is formed in the sleeve 42 and a resilient tongue or spring 84 is formed which is biased into the tube cavity 70 or 72. For convenience, the tube clip 80 is formed on the opposite side of the sleeve 42 from the key 58. The tongue 84 provides a frictional bias against a tube placed into the tube adapter to retain the tube until it is desired to remove the tube. The bias can be overcome by asserting a force, such as a finger, against the tube end in the opening 46.

Referring to FIGS. 6A–6D, the tube adapters 40, 40' and 40" are illustrated in a universal stripper plate 90 aligned for aspiration such as in the aspiration station 14. The stripper plate 90 can be any type of stripper plate, but is illustrated with the universal stripper plate 90 described in the cross-referenced application Case No. 139,581, entitled "Universal Stripper Plate". The universal stripper plate 90 replaces the stripper plate 28 and includes a stripper button 92 which replaces the button 30 illustrated in FIG. 2.

Figure 6A:
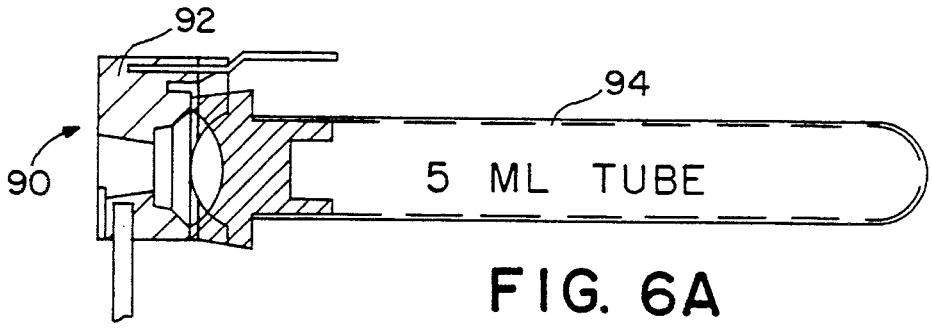
FIGS. 6A–6D are side partial sectional views of different tubes in the tube adapter embodiments of the present invention.
Figure 6B:
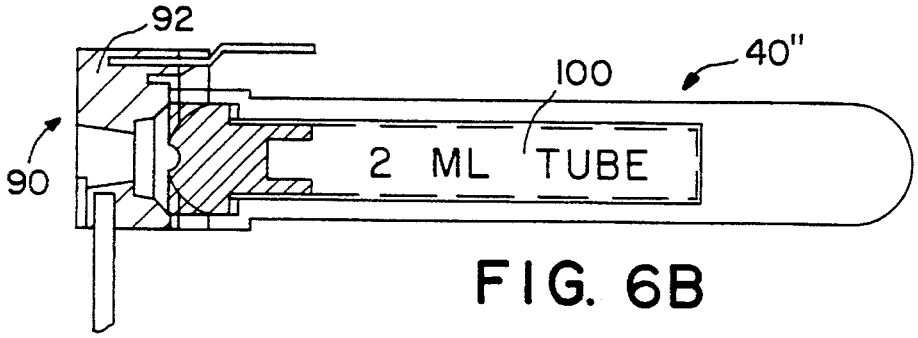
Figure 6C:
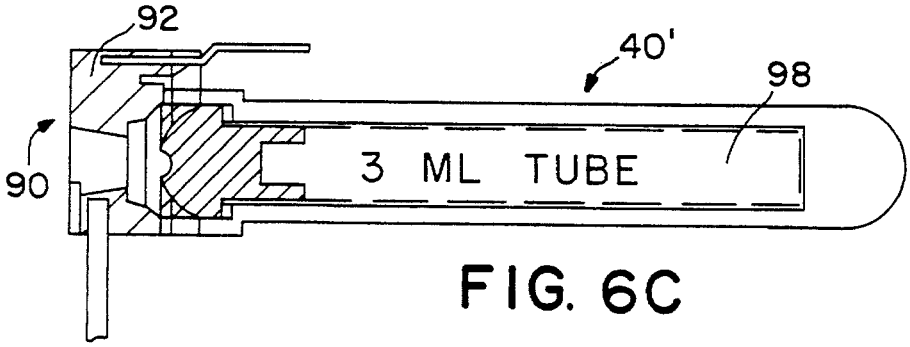
Figure 6D:
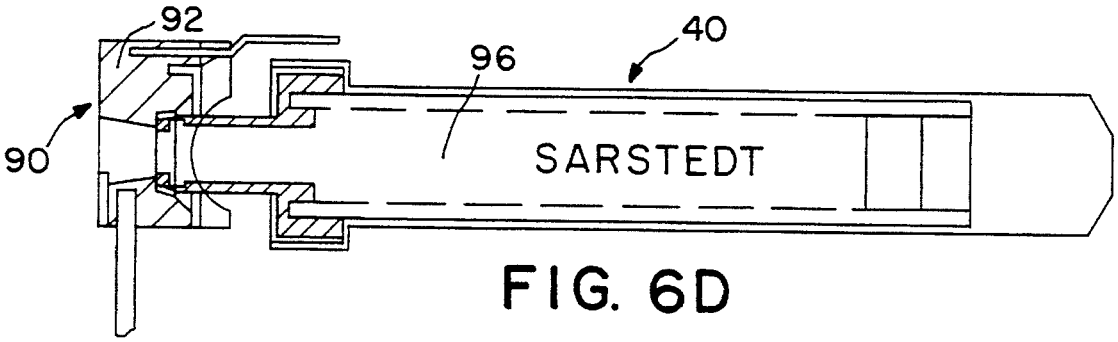

The hematology analyzer 10 generally is preset to accommodate a specific size and type of tube such as a five (5) ml tube 94 (FIG. 6A). The fixed tube sensor 38 is preset for this size (diameter tube) and cannot accommodate tubes which have a diameter differing significantly from the diameter of the tube 94, without physical adjustment. The tube adapters 40, 40' and 40" increase the diameter of respective tubes 96, 98 and 100 inserted therein, such that the tube sensor 38 and the hematology analyzer 10 can operate on these different tubes without physical adjustment. Further, the self-adjusting tube detector incorporated herein adds further flexibility to the analyzer 10 to accommodate other diameter tubes, such as a seven (7) ml tube (not illustrated).

As described with respect to FIG. 3, the alignment key 58 preferably includes a spring clip to retain the tube adapter 40 in the cassette 18. The alignment key 58 can be replaced by an alignment key 102 as illustrated in FIG. 7. The alignment key 102 includes a base 104 which can be adhered to or formed with the sleeve 42. The alignment key 102 includes a pair of arms 106 and 108. The arms 106 and 108 include respective front tapered portions 110 and 112 to perform the insertion function of the portion 62. The portions 110 and 112 include clip portions 114 and 116 which form a second spring clip with the cassette slot to prevent the tube adapters from inadvertently being dislodged from the cassette 18. The portions 114 and 116 can be rigid with a flexible cassette slot or the portions 114 and 116 can be flexible to form the spring clip action if the cassette slot is rigid.

Many modifications and variations of the present invention are possible in light of the above teachings. Other types of adapters can include different materials, which can be numbered and/or color coded as desired. The balance of the tube adapters can be adjusted as desired by utilizing the base portions, for example 74 and 76. The tube adapters can be formed from one or more separate pieces such as by a one-piece injection molding or adhesively securing separate pieces. Other types of tube sensors also could be utilized, including optical beam sensing, acoustic reflection or other sensing techniques. It is therefore to be understood that within the scope of the appended claims, the invention may be practiced otherwise than as specifically described.

We claim:

1. A tube adapter, comprising:

a sleeve having a desired length, outer diameter and an internal cavity having a diameter to accommodate a predetermined type of tube;

said sleeve including a shoulder formed at least partially around a cavity opening in one end of the sleeve into which opening a rube is inserted; and said sleeve including tube retaining means for retaining the tube inserted into said cavity including a resilient spring portion mounted on said sleeve and biased into said cavity to retain said tube.

2. The tube adapter as defined in claim 1 including said spring portion formed from a portion of said sleeve adjacent said shoulder.

3. The tube adapter as defined in claim 1 including a bar code reader slot formed through said sleeve along the length thereof.

4. The tube adapter as defined in claim 3 including means for aligning said sleeve in a tube holder or cassette with said bar code reader slot having a predetermined alignment.

5. The tube adapter as defined in claim 4 wherein said aligning means include a guide formed on said sleeve.

6. The tube adapter as defined in claim 5 including said guide formed substantially aligned with said bar code reader slot.

7. The tube adapter as defined in claim 5 wherein said guide and said cassette include retaining means for retaining said sleeve in said cassette.

8. The tube adapter as defined in claim 7 wherein said guide includes a pair of tapered arms adapted to fit in a slot formed in said cassette.

9. The tube adapter as defined in claim 4 including said tube retaining means spring portion and said bar code reader slot formed on substantially opposite sides of said sleeve.

10. The tube adapter as defined in claim 1 including a bar code reader slot formed through said sleeve along the length thereof.

* * * * *